US007552832B2

(12) United States Patent
Suffa

(10) Patent No.: US 7,552,832 B2
(45) Date of Patent: Jun. 30, 2009

(54) CLOSURE CAP FOR CLOSING NON-ROTATIONALLY SYMMETRICAL OR ECCENTRIC MOUTHPIECE OPENINGS OF BOTTLE CONTAINERS

(75) Inventor: Udo Suffa, Gefell (DE)

(73) Assignee: Alpla-Werke Alwin Lehner GmbH & Co. KG (AT)

( * ) Notice: Subject to any disclaimer, the term of this patent is extended or adjusted under 35 U.S.C. 154(b) by 0 days.

(21) Appl. No.: 11/387,521

(22) Filed: Mar. 23, 2006

(65) Prior Publication Data

US 2006/0191804 A1 Aug. 31, 2006

Related U.S. Application Data

(63) Continuation of application No. PCT/EP2004/051993, filed on Sep. 1, 2004.

(30) Foreign Application Priority Data

Sep. 23, 2003 (DE) ..... 103 44 242
Dec. 30, 2003 (DE) ..... 103 61 613

(51) Int. Cl.

| | |
|---|---|
| ***B65D 39/02*** | (2006.01) |
| ***B65D 41/04*** | (2006.01) |
| ***B65D 83/00*** | (2006.01) |
| ***B65D 51/18*** | (2006.01) |
| ***A47G 19/22*** | (2006.01) |

(52) U.S. Cl. ..... 215/236; 215/217; 215/341; 215/387; 220/304; 220/255; 220/717; 222/478; 222/546; 222/567

(58) Field of Classification Search ..... 215/236, 215/219, 217, 296, 264, 364, 387, 341, 354; 220/256.1, 304, 259.1, 259.2, 259.3, 254.2, 220/717, 254.1, 254.4, 255; 222/482–484, 222/566, 567, 478, 489, 507, 548
See application file for complete search history.

(56) References Cited

U.S. PATENT DOCUMENTS 2,312,738 A * 3/1943 Ulanet ..... 215/354

(Continued)

FOREIGN PATENT DOCUMENTS

| | | |
|---|---|---|
| DE | 196 16 000 | 10/1997 |
| FR | 1.401.450 A | 6/1965 |
| SU | 1671537 A1 | 8/1991 |

OTHER PUBLICATIONS

International Search Report, Feb. 9. 2005, 3 pages.

(Continued)

*Primary Examiner*—Robin Hylton
(74) *Attorney, Agent, or Firm*—St. Onge Steward Johnston & Reens LLC

(57) ABSTRACT

A closure cap system is provided, including a closure cap which is preferably produced according to a plastic injection molding method and provided with a closure stopper which can be placed on a neck opening which is also preferably made of plastic, said neck opening being that of a bottle container. The closure cap is provided with a bottom and the closure stopper is formed on the inner side of the cap bottom opposite the neck opening. In order to create a functionally secure stopper, said closure stopper is arranged on a plane in a parallel position with regard to the cap bottom such that it can pivot in relation thereto.

24 Claims, 6 Drawing Sheets

U.S. PATENT DOCUMENTS 3,115,981 A * 12/1963 Darmstadt et al. ..... 215/12.1
3,973,690 A * 8/1976 Schneider ..... 215/329
4,665,668 A * 5/1987 Serpico ..... 52/169.2
5,346,097 A 9/1994 Melland et al. ..... 222/132
6,550,647 B1 4/2003 Künz ..... 222/129

OTHER PUBLICATIONS

English Translation of SU 1671537, 3 pages.
English Translation of DE19616000, 3 pages.

* cited by examiner 1
2
3
4
6
7
8
9
9
10
10
11
12
12
13
14
15
16
17
18
19
19
20
21
x
x

CLOSURE CAP FOR CLOSING NON-ROTATIONALLY SYMMETRICAL OR ECCENTRIC MOUTHPIECE OPENINGS OF BOTTLE CONTAINERS

CROSS-REFERENCE TO RELATED APPLICATIONS

The present application is a continuation of pending International patent application PCT/EP2004/051993 filed on Sep. 1, 2004 which designates the United States and claims priority from German patent application Nos. 10344242.1 filed on Sep. 23, 2003 and 10361613.6 filed on Dec. 30, 2003, the content of which is incorporated herein by reference.

FIELD OF THE INVENTION

The invention relates firstly to a closure cap which is produced using the plastics injection molding process. The invention further relates to a combination of a closure cap and a receiving vessel.

BACKGROUND OF THE INVENTION

Various embodiments of closure caps of the type in question are known, such as in particular closure caps which, on the inner side of the cap base, have a central closure stopper, formed integrally on the base, for a mouthpiece opening.

Among known closures of the above-mentioned kind, compare for example DE 196 16 000 A1 and SU 1 671 537 A1, the closure stopper which is rotatable relative to the cap base is not usable for mouthpiece openings of the associated container which are disposed non-rotationally symmetrically or somewhat eccentrically with respect to the central axis of rotation of the cap base.

With regard to the prior art mentioned, the object of the invention in respect of the closure cap is seen in the provision of a closure cap with a closure stopper which is rotatable relative to a closure cap base and which is also usable in the case of non-rotationally symmetrical mouthpiece openings and/or eccentric disposition of a mouthpiece opening.

In regard to the combination of closure cap and receiving vessel, reference to the state of the art is made for example to U.S. Pat. No. 6,550,647 B1. From this, it is not however already known to provide a rotary closure cap with a central axis of rotation.

SUMMARY OF THE INVENTION

The object of the invention is in this respect the provision of a suitable combination by virtue of which non-rotationally symmetrical mouthpiece openings and/or eccentric mouthpiece openings may also advantageously be closed.

On account of this configuration, the orientation and association of closure stopper and mouthpiece opening are ensured and simplified during fitting of the closure cap onto the mouthpiece opening region of the bottle vessel. Any manufacturing tolerances can be compensated for by the closure stopper being disposed pivotably. In particular, an eccentrically disposed mouthpiece opening can be reliably closed off via the closure stopper by means of the closure cap according to the invention. The rotary-alignment part serves to automatically direct the closure stopper into the position of association with respect to the mouthpiece opening.

In this respect, similar aspects also apply in regard to the subject matter of the closure cap. Therefore, the closure stopper, during fitting of the closure cap onto the bottle vessel, is forcibly displaced, by means of the rotary-alignment part, which furthermore is preferably disposed such that it rotates with the closure stopper in the closure cap, into the association position. In a preferred configuration, the closure stopper is formed on a holding plate which is disposed such that it can rotate relative to the cap base and is mounted rotatably, in the manner of a disk, around a central axis of rotation of the closure cap. The closure stopper and the associated mouthpiece opening may be disposed centrally. The invention has proven particularly advantageous in a configuration in which the closure stopper and the mouthpiece opening are disposed eccentrically relative to a central axis of rotation of the closure cap. On account of the closure stopper being disposed pivotably in accordance with the invention, therefore, even a mouthpiece opening of the bottle vessel that is disposed eccentrically with respect to the central axis of rotation of the closure cap can be reliably closed by the closure stopper on the cap side. On account of the configuration according to the invention, it is also possible to achieve a more reliable closure of a multicomponent bottle vessel having a corresponding plurality of mouthpiece openings, in which case one central mouthpiece opening may also be associated with one or more eccentrically disposed mouthpiece openings. Therefore, it is furthermore proposed that two oppositely-disposed closure stoppers, with rotary-alignment parts located between them in the direction of rotation, are disposed on the holding plate. A configuration in which the closure stoppers and accordingly also the mouthpiece openings are disposed diametrically opposite is preferred. Each closure stopper can be associated with one mouthpiece opening of the bottle vessel. It is also conceivable for more than two closure stoppers to be disposed for the purpose of closing off a corresponding number of mouthpiece openings. The rotary-alignment part disposed between the closure stoppers is used to automatically orientate the holding plate and, by means of this, the closure stoppers during fitting of the closure cap onto the bottle vessel. The preferably disk-like holding plate may be held on the cap base at the boundary side. It is also conceivable for the holding plate to be seated on a latching pin which is formed on the cap base and preferably disposed centrally, which latching pin at the same time forms the body axis of rotation for the holding plate. In particular in the case of a holding plate which is formed with a reduced diameter compared to the cap base, it is also provided that centering formations be formed on the cap base to facilitate mounting of the holding plate. Furthermore, it is preferable for the centering formations and the latching pin to be formed integrally, from the same material, on the cap base. In its most simple form, the closure cap according to the invention may be formed as a press-fit cap with a self-aligning closure stopper. A configuration in which the closure cap is a screw cap is preferred. As the cap is being screwed on, the rotary-alignment parts are responsible for orientating the position of the closure stoppers with respect to the mouthpiece openings. The solution according to the invention has also proven advantageous for a configuration with just one central mouthpiece opening. The stopper, which has been displaced axially towards the mouthpiece opening as the cap is being screwed on, is held frictionally on the mouthpiece wall. The further displacement of the cap as it is being screwed on then merely effects a linear displacement of the stopper into the opening. This counteracts any abrasion in this region of interaction.

Furthermore, the invention relates to a combination of a closure cap, which is preferably produced using the plastics injection molding process and has a closure stopper, and a receiving vessel, preferably a bottle, which has at least one mouthpiece opening, which preferably likewise consists of plastics and is formed eccentrically with respect to a central axis of rotation of the closure cap, the closure cap having a cap base, and the closure stopper being formed on the inner side of the cap base, facing the mouthpiece opening. To make such a combination of closure cap and receiving vessel more functionally reliable, in particular with regard to the closure of the mouthpiece opening, it is proposed that the closure stopper is disposed such that it can pivot relative to the cap base in a plane that is parallel to the cap base, and that the mouthpiece opening is formed such that it is raised up with respect to a surrounding vessel cover of the receiving vessel. The mouthpiece opening of the receiving vessel is disposed in a central region, which is elevated with respect to the vessel cover, although the mouthpiece opening does not necessarily have to be disposed centrally, but rather may also be disposed eccentrically with respect to a vessel cover center axis. It is also provided that the rotary-alignment part is formed on an arc of a circle which intersects the closure stopper or mouthpiece opening. On account of this configuration, automatic alignment of the cap-side closure stopper with respect to the mouthpiece opening is achieved while the closure cap is being attached. Therefore, it is further provided that the closure cap is held on the discharge vessel by means of a screw closure, and that the screw closure is not (yet) active when the rotary-alignment part collides with the mouthpiece opening. On account of this configuration, the screw closure can be made to become active only once the closure stopper has been oriented in a deliberate way with respect to the mouthpiece opening. Finally, it is provided that when the closure cap has been screwed on, the rotary-alignment part is disposed above the vessel cover and laterally with respect to the mouthpiece opening formation.

BRIEF DESCRIPTION OF THE DRAWINGS

The invention is explained in more detail below on the basis of the appended drawings, which illustrate just two exemplary embodiments and in which.

DETAILED DESCRIPTION OF THE INVENTION

Figure 2:
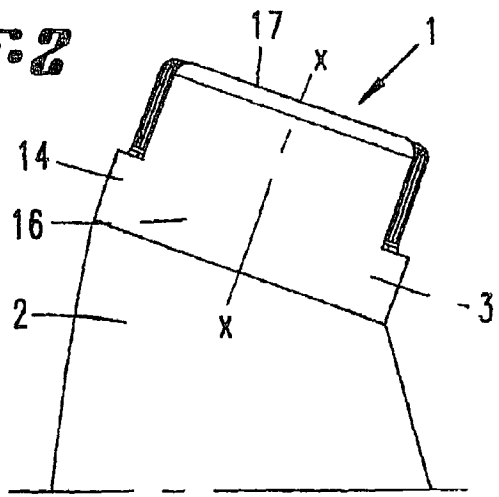
FIG. 2 shows the side view of this.
Figure 1:
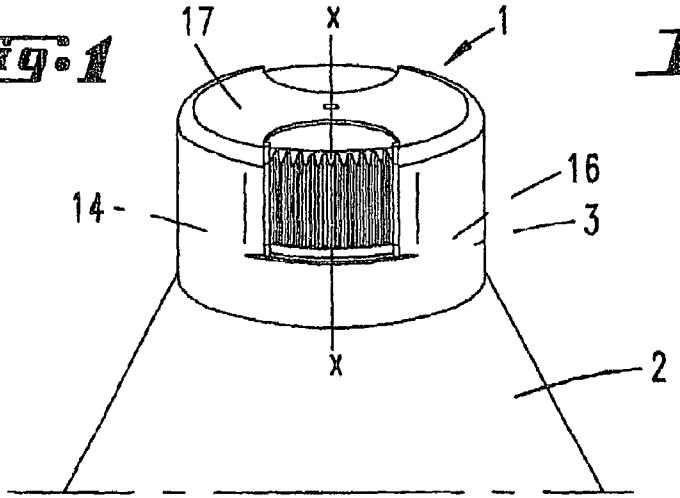
FIG. 1 shows a view of a combination according to the invention of a closure cap and a bottle, which is only indicated, relating to the closed position of the closure cap.
Figure 3:
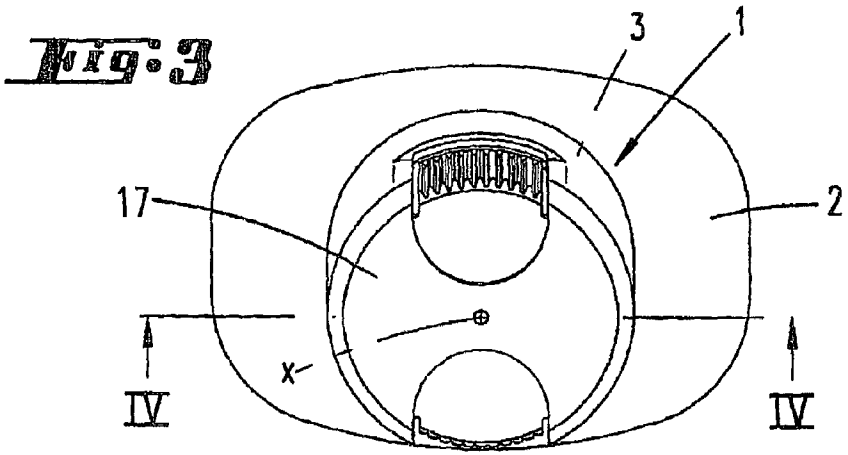
FIG. 3 shows the plan view of this.
Figure 4:
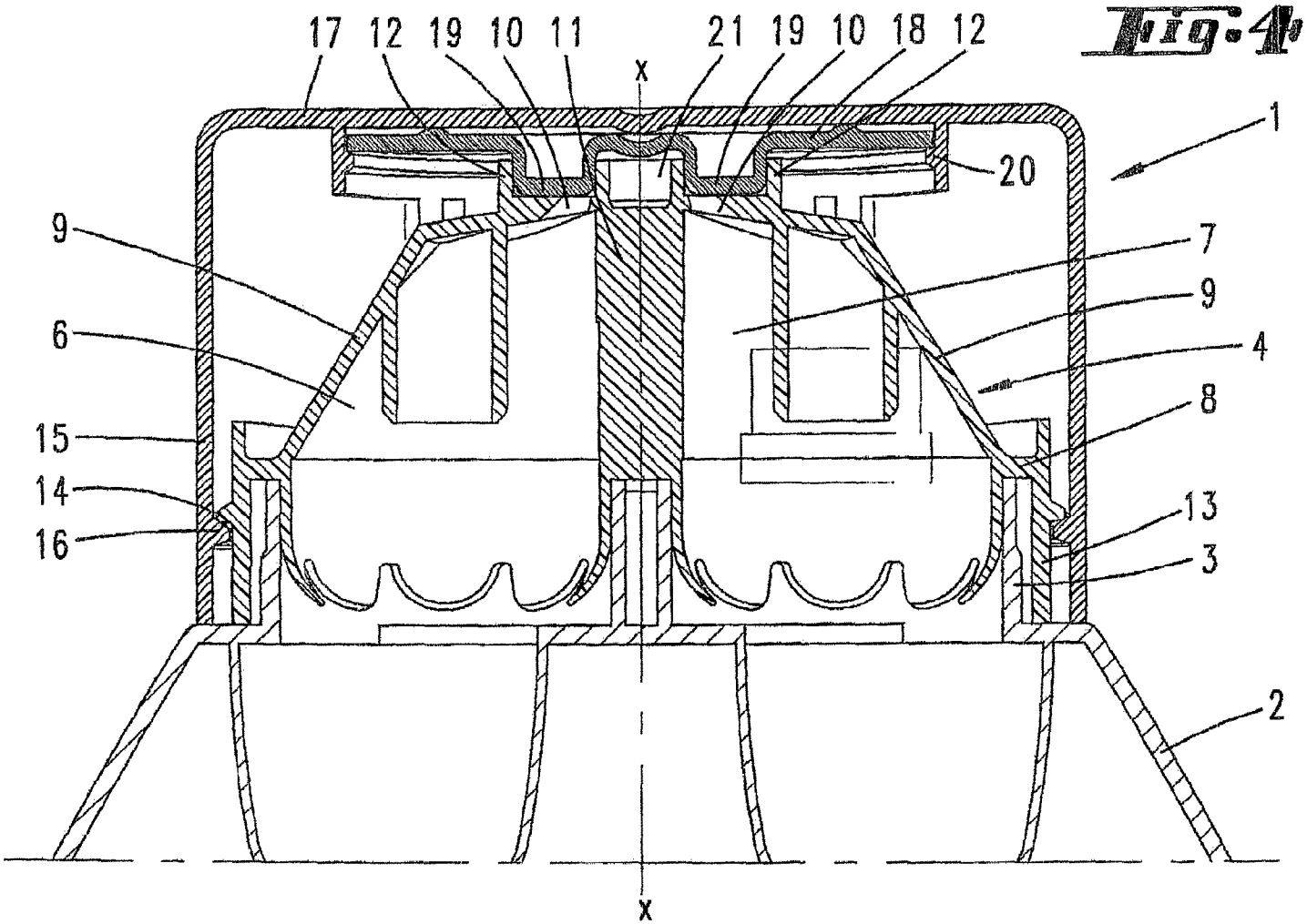
FIG. 4 shows the enlarged section on line IV-IV in FIG. 3.
Figure 5:
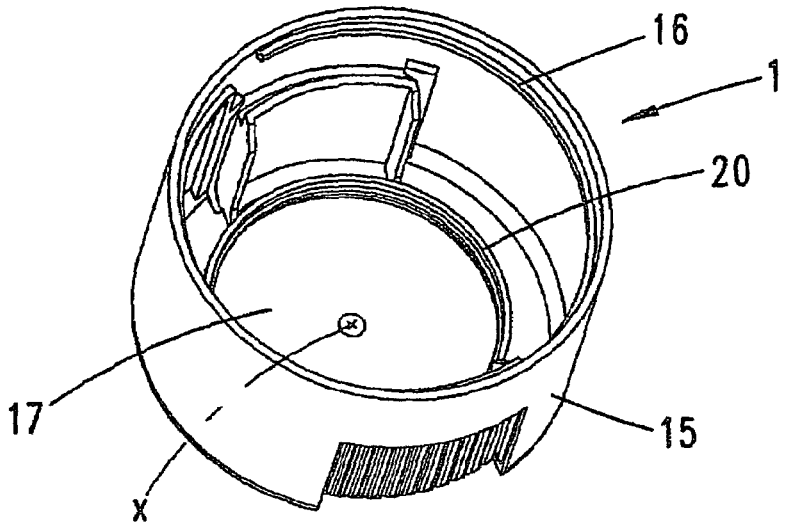
FIG. 5 shows a perspective view of the closure cap from below, with a holding plate omitted.
Figure 6:
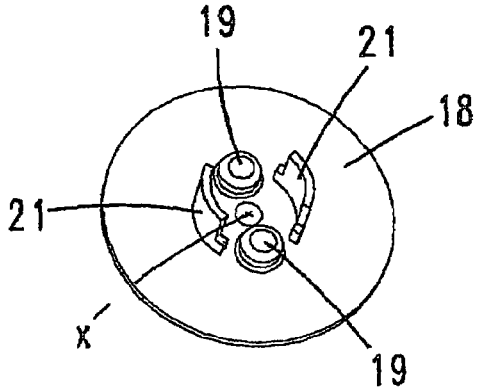
FIG. 6 shows a perspective view of the holding plate from below.
Figure 7:
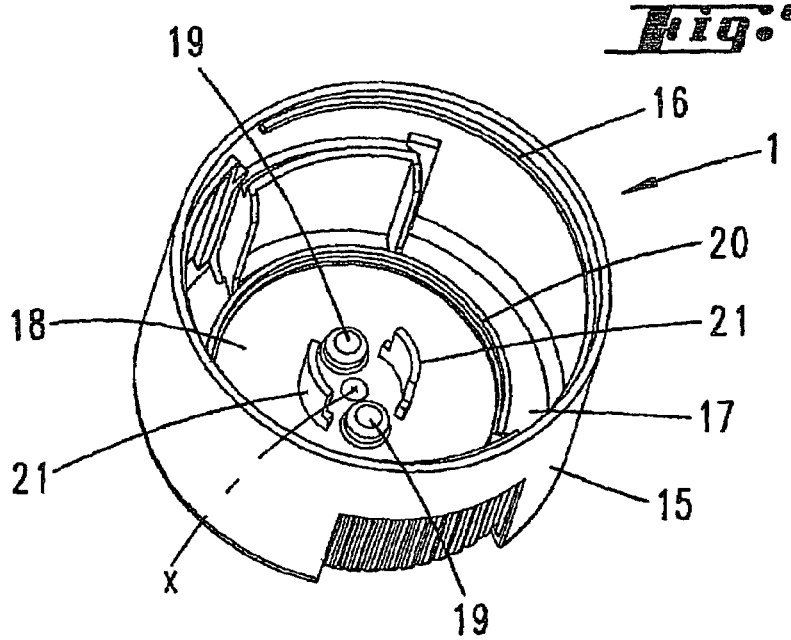
FIG. 7 shows the closure cap illustrated in FIG. 5, but after the holding plate has been associated with it.

FIGS. 1 to 3 show the combination according to the invention of a closure cap 1 produced using the plastics injection molding process and a receiving vessel or bottle vessel 2.

The receiving vessel 2 is formed as a two-component vessel and has a discharge head 4, which is secured, for example press-fitted, on the vessel neck 3 and has two discharge chambers 6 and 7, which are unambiguously associated with the component regions of the vessel 2.

The discharge head 4 has a vessel cover 8 that is supported on the neck 3 of the vessel 2. This vessel cover 8 is substantially disk-like in form and extends transversely with respect to a center axis of the discharge head 4, which is circular in contour.

Figure 8:
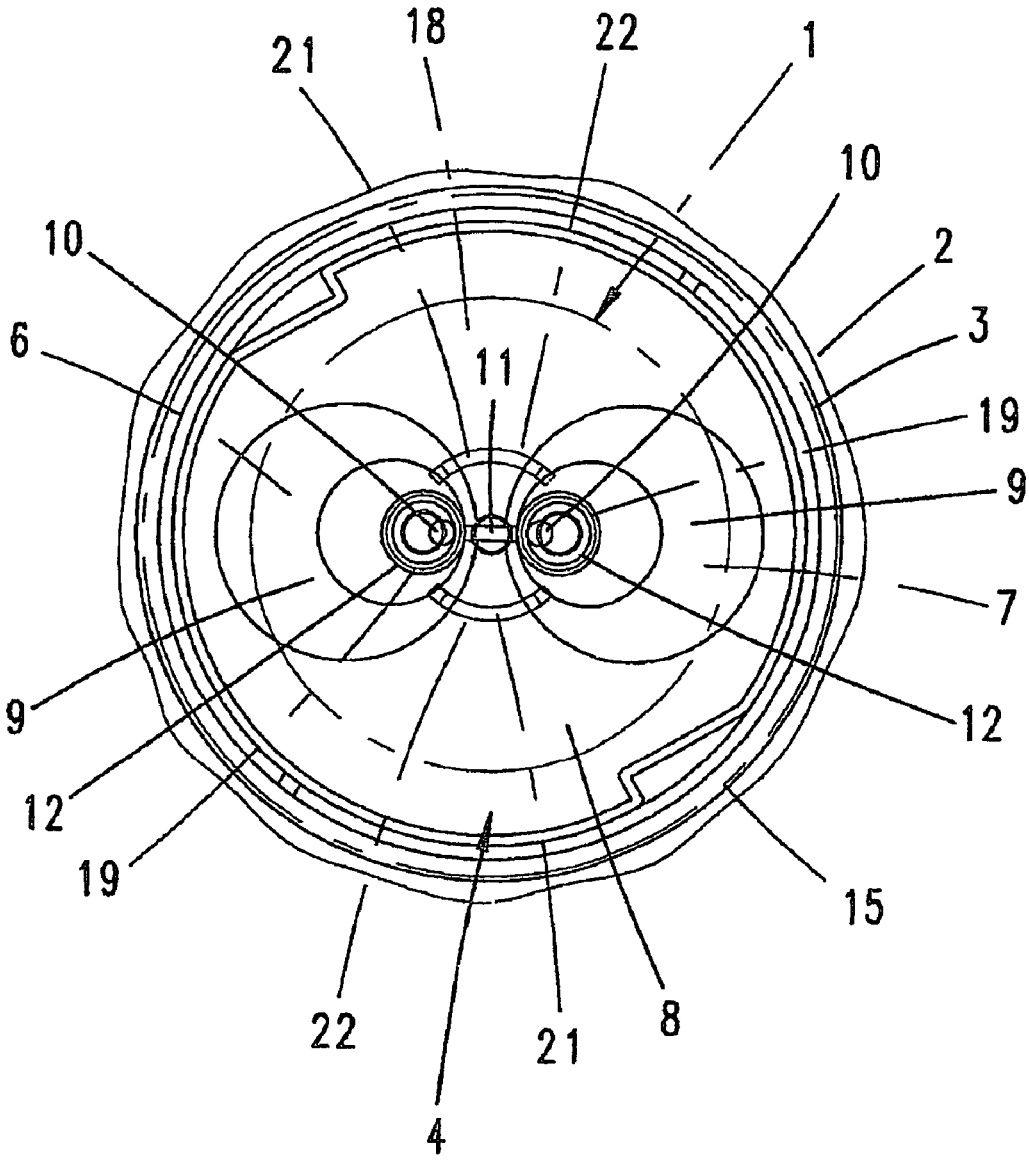
FIG. 8 shows the plan view of the vessel cover of the bottle vessel, with an illustration of the holding plate and the closure stoppers in the closed position reproduced by dot-dashed lines.

Two elevations 9, which face away from the vessel 2, are circular in cross section, form the discharge chambers 9 and 10 and narrow in cross section from the vessel cover 8 toward their free ends, extend from this vessel cover 8. At the end side, the elevations 9 are in each case provided with a mouthpiece opening 10, associated with a discharge chamber 6 and 7, for the stored medium. When seen in plan view, these mouthpiece openings 10 are disposed diametrically opposite and eccentrically with respect to the discharge head center axis. Furthermore, as can be seen from the plan view illustrated in FIG. 8, these mouthpiece openings 10 are formed in the adjacent circle-edge sections of the elevation covers, leaving a distance defined by a web 11 connecting the elevations 9.

Furthermore, the mouthpiece openings 10 are surrounded by annular walls 12 oriented eccentrically with respect to the opening axis, which annular walls 12, when interacting with the closure cap 1—as explained in more detail below—perform a sealing function.

A circumferential strip 13, which on the outer lateral side bears an external screw thread 14 and which surrounds the vessel neck 3, extends on the edge side of the vessel cover 8.

The discharge head, and in particular the region which includes the mouthpiece openings 10, is likewise preferably made from plastics.

In a known way, the closure cap 1 has a pot-like form with a circular contour, an encircling cap wall 15, on the inner lateral side, bearing an internal screw thread 16 that interacts with the external screw thread 14 of the discharge head 4.

On the inner side, i.e. facing the discharge head 4, the cap base 17 carries a disk-like holding plate 18, on which the closure stoppers 19 are disposed for sealing closure of the mouthpiece openings 10 of the discharge head 4. This holding plate 18 is substantially in the form of a circular disk and is held such that it is pivotable and/or rotatable, in a plane parallel to the cap base 17, about the central axis of rotation x of the closure cap 1.

The holding plate 18, a first embodiment of which is illustrated in FIGS. 1 to 8, has a cap-side latching bead 20 engaging over its circumferential edge, this latching bead ensuring on the one hand that the holding plate 18 is held captively on the closure cap 1 and on the other hand that the holding plate 18 can rotate freely on the underside of the cap base 17.

The two closure stoppers 19 are disposed diametrically opposite, eccentrically with respect to the axis of rotation x, at a spacing from one another which corresponds to the spacing between the two mouthpiece openings 10 of the discharge head 4.

The diameter of each closure stopper 19 is matched to the internal diameter of the annular walls 12 of the mouthpiece openings 10.

As seen in the direction of rotation of the holding plate 18, rotary-alignment parts 21 are formed on the underside of the holding plate 18, between the two oppositely-disposed closure stoppers 19. These rotary-alignment parts 21 are formed as circle-segment walls which are disposed on an arc of a circle which is oriented so as to intersect the closure stoppers 19 coaxially with respect to the axis of rotation x (cf. in particular the illustration presented in FIG. 8). The narrow side edges, facing in the circumferential direction, of these rotary-alignment parts 21 are disposed at a distance from the adjacent closure stoppers 19, with a secant dimension, i.e. the clear distance between two narrow edges of a rotary-alignment part 21, being matched to the clear dimension between the elevations 9 of the discharge head 4 in the region of the pocket 23 formed between the elevations 9.

The closure cap 1, which is formed as a screw cap, in order to close the vessel 2, is screwed onto the discharge head 4 in the usual way by means of a screwing motion of the closure cap 1, with the closure stoppers 19 being oriented with respect to the mouthpiece openings 10 by means of the rotary-alignment parts 21, with a rotary motion of the holding plate 18 relative to the closure cap 1. Provided that the rotary-alignment parts 21 collide with the mouthpiece openings 10 when the closure cap 1 is first being fitted onto the discharge head 4, the selected height formation of external screw thread 14 on the discharge head side and internal screw thread 16 on the cap side means that it is impossible for the screw closure to become active, since the rotary-alignment parts 21, which are engaging against the mouthpiece openings 10 and/or against the annular walls 12 surrounding them, do not allow the closure cap 1 to be lowered sufficiently far for threaded engagement. Only through slight rotation of the closure cap 1 or refitting of the closure cap 1 in a slightly turned position causes the holding plate 18 to be aligned in such a manner that the closure stoppers 19 are positioned exactly above the mouthpiece openings 10. The edge walls of the elevations 9 which bear the mouthpiece openings 10 assist the self-aligning effect by virtue of the rotary-alignment parts 21 being in this way displaced accurately in the pockets 22 formed between the elevations 9, with rotation of the holding plate 18. The located closure situation is illustrated by dot-dashed lines in FIG. 8.

Only once mouthpiece openings 10 and closure stoppers 19 have been disposed accurately one above the other is the closure cap 1 lowered sufficiently far for it to be possible for external and internal screw threads to engage with one another in order to secure the closure cap 1, with the closure stoppers 19, during the screwing-on operation, moving into the space, which is delimited by the annular walls 12, as a result of linear displacement parallel to the cap axis x in order to close off the mouthpiece openings 10 in a sealing manner.

Figure 9:
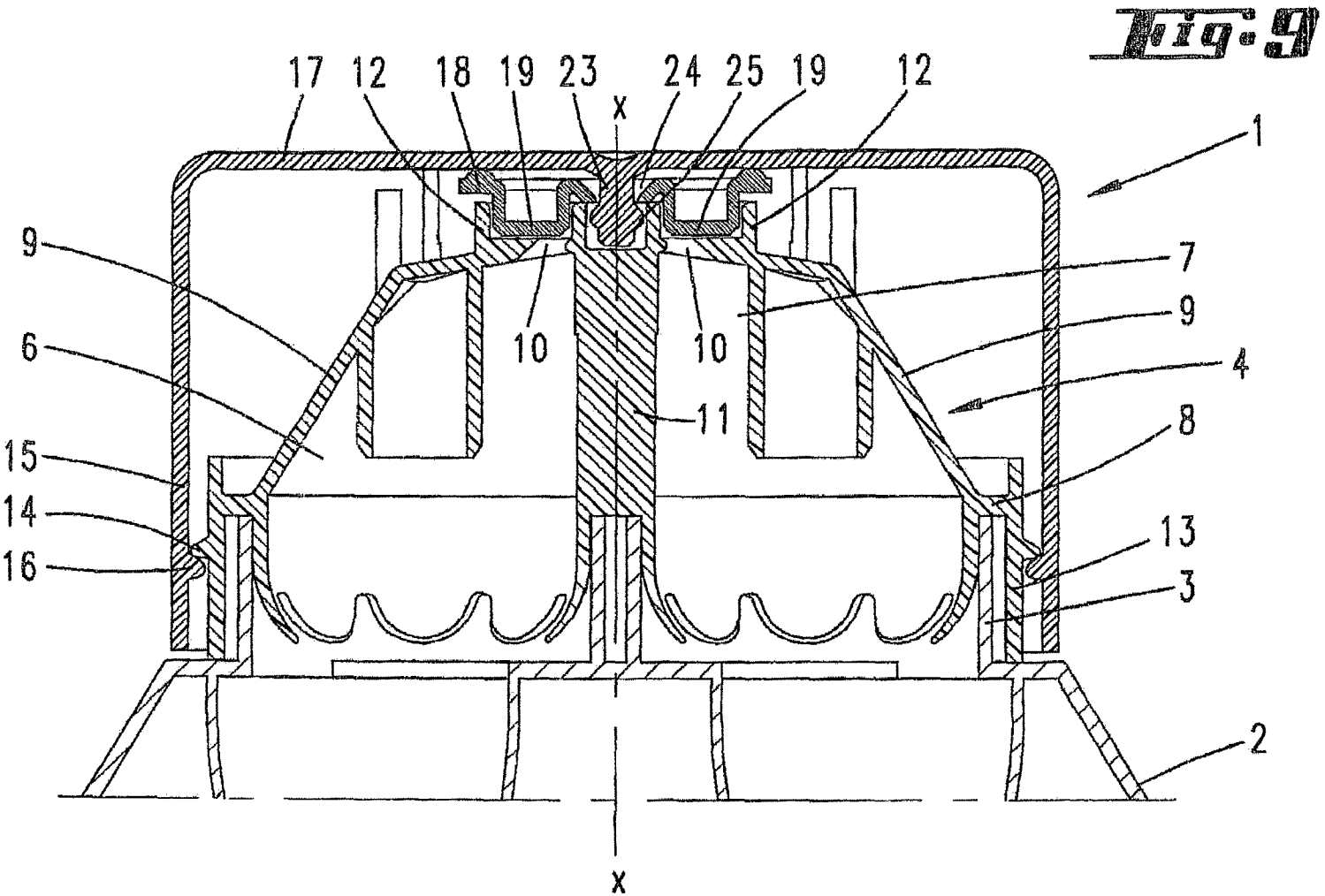
FIG. 9 shows a sectional illustration corresponding to FIG. 4, but relating to a second embodiment of the holding plate.
Figure 10:
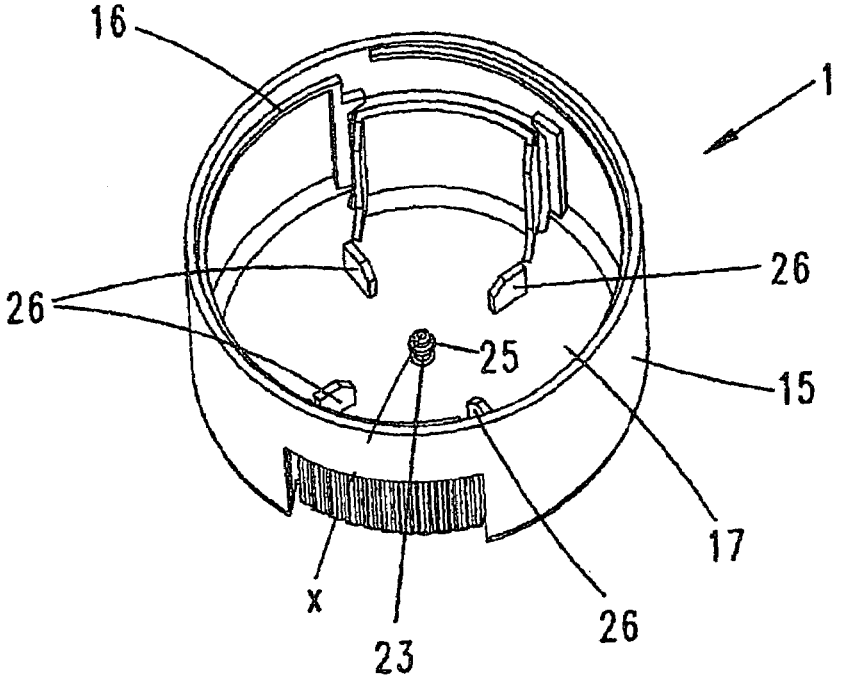
FIG. 10 shows a perspective view from below of the closure cap of the second embodiment, with the holding plate omitted.
Figure 11:
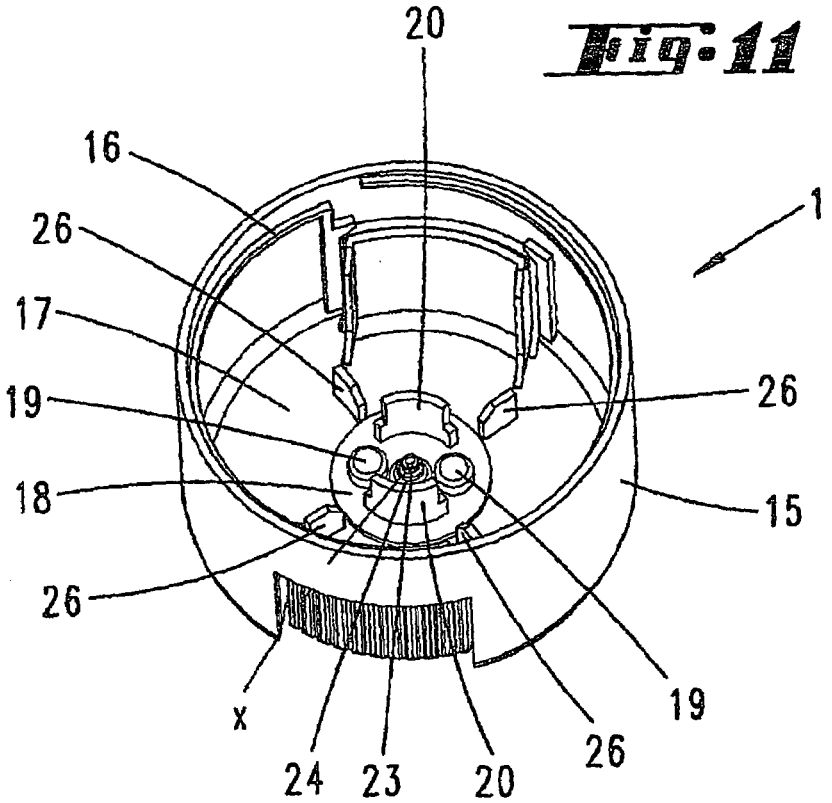
FIG. 11 shows a perspective view from below of the second embodiment, toward the closure cap, but after the holding plate has been associated.

FIGS. 9 to 11 show a second embodiment of the closure cap 1, in which the diameter of the holding plate 18 is reduced compared to the first exemplary embodiment, having approximately half the diameter by comparison with the latter. An inwardly facing latching pin 23 is formed on the cap base 17 to rotatably fix the holding plate 18. This latching pin 23 is preferably formed integrally with the cap base 17, from the same material, and to rotatably fix the holding plate 18 has an annular collar 25 which engages over a central aperture 24 in the holding plate 18.

On account of the selected formation, the aperture 24 is positioned centrally between the two closure stoppers 19. The way in which the closure stoppers 19 and rotary-alignment parts 21 are disposed and oriented, and also their respective size ratios, correspond to those of the first embodiment.

To facilitate fitting of the holding plate 18, radially oriented, web-like centering formations 26, which point downward from the cap base 17, are formed on the cap base 17. In the exemplary embodiment illustrated, four centering formations 26, which are distributed circumferentially uniformly with respect to the axis of rotation x, are provided, with two oppositely-disposed centering formations 26 being spaced apart from one another in accordance with the diameter of the holding plate 18.

All the features disclosed are (inherently) pertinent to the invention. The content of disclosure of the associated/appended priority documents (copy of the prior application) is hereby incorporated in its entirety in the disclosure of the application, partly with a view to incorporating features of these documents in claims of the present application.

What is claimed is:

1. A closure cap which has a closure stopper for closure of a mouthpiece opening that is formed on a discharge head of a bottle vessel, the closure cap comprising a cap base, the closure stopper being located on the inner side of the cap base, facing the mouthpiece opening, and the closure stopper being disposed such that the closure stopper is pivotable relative to the cap base in a plane parallel to the cap base, wherein further the closure stopper and a rotary-alignment part for interaction with the discharge head are provided on a holding plate, which holding plate can rotate freely on the inner side of the cap base, wherein the rotary-alignment part comprises at least one segment wall member, and wherein the closure stopper and the mouthpiece opening are disposed eccentrically relative to a central axis of rotation of the closure cap.

2. A closure cap according to claim 1, characterized in that when the rotary-alignment part interacts with the discharge head, the closure stopper, despite the closure cap rotating, moves into a closure position without rotation and purely by means of a lowering motion.

3. A closure cap according to claim 1, characterized in that the holding plate is disk-shaped.

4. A closure cap according to claim 1, characterized in that two oppositely-disposed closure stoppers, with rotary-alignment parts located between them in the direction of rotation, are disposed on the holding plate.

5. A closure cap according to claim 3, characterized in that the disk-shaped holding plate is seated on a latching pin which is formed on the cap base.

6. A closure cap according to claim 3, characterized in that centering formations are formed on the cap base and are distributed circumferentially uniformly thereon to facilitate central mounting of the disk-shaped holding plate on the cap base.

7. A closure cap according to claim 1, characterized in that the closure cap is a screw cap.

8. A combination of a closure cap, which has a closure stopper for closing at least one mouthpiece opening, and a receiving vessel, which has the at least one mouthpiece opening that is formed on a discharge head of the receiving vessel, wherein the at least one mouthpiece opening is formed eccentrically with respect to a central axis of rotation of the closure cap, the closure cap comprising a cap base, and the closure stopper being located on the inner side of the cap base, facing the at least one mouthpiece opening, wherein the closure stopper is disposed such that the closure stopper is pivotable relative to the cap base in a plane that is parallel to the cap base, and in that the at least one mouthpiece opening is formed such that the at least one mouthpiece opening is raised up with respect to a disk-like vessel cover of the discharge head of the receiving vessel and in that a rotary-alignment part is provided on the inner side of the cap base, which interacts with the discharge head, wherein further the rotary-alignment part rotates with the closure stopper and comprises at least one segment wall member.

9. A combination according to claim 6, characterized in that the closure cap is held on the discharge head by means of a screw closure, and in that the screw closure is not yet active when the rotary-alignment part collides with the at least one mouthpiece opening.

10. A combination according to claim 9, characterized in that when the closure cap has been screwed on, the rotary-alignment part is disposed above the disk-like vessel cover and laterally with respect to the at least one mouthpiece opening formation.

11. A combination according to claim 8, characterized in that during the interaction of the rotary-alignment part with the discharge head, the closure stopper, despite the closure cap rotating, moves into a closure position without rotation, and purely by means of a lowering motion.

12. A closure cap which is produced using a plastics injection molding process and has a closure stopper for closure of a mouthpiece opening that is formed on a discharge head of a bottle vessel, likewise consisting of plastics, the closure cap having a cap base, the closure stopper being located on the inner side of the cap base, facing the mouthpiece opening, and the closure stopper being disposed such that the closure stopper is pivotable relative to the cap base in a plane parallel to the cap base, wherein further the closure stopper and a rotary-alignment part are provided on a holding plate, which holding plate can rotate freely on the inner side of the cap base, and wherein the rotary-alignment part does consist of at least one segment wall member, and wherein the closure stopper and the mouthpiece opening are disposed eccentrically relative to a central axis of rotation of the closure can.

13. A closure cap according to claim 12, characterized in that the rotary-alignment part interacts with the discharge head, and the closure stopper, despite the closure cap rotating, moves into the closure position without rotation and purely by means of a lowering motion.

14. A closure cap according to claim 12, characterized in that the holding plate is disk-shaped.

15. A closure cap according to claim 12, characterized in that two oppositely-disposed closure stoppers, with rotary-alignment parts located between them in the direction of rotation, are disposed on the holding plate.

16. A closure cap according to claim 14, characterized in that the disk-shaped holding plate is seated on a latching pin which is formed on the cap base.

17. A closure cap according to claim 14, characterized in that centering formations are formed on the cap base and are distributed circumferentially uniformly thereon to facilitate central mounting of the disk-shaped holding plate on the cap base.

18. A closure cap according to claim 12, characterized in that the closure cap is a screw cap.

19. A combination of a closure cap for closing at least one mouthpiece opening, which is produced using a plastics injection molding process and has a closure stopper, and a receiving vessel, which has the at least one mouthpiece opening that is formed on a discharge head of the receiving vessel that likewise consists of plastics, wherein the at least one mouthpiece opening is eccentric with respect to a central axis of rotation of the closure cap, the closure cap comprising a cap base, and the closure stopper being located on the inner side of the cap base, facing the at least one mouthpiece opening, wherein the closure stopper is disposed such that the closure stopper is pivotable relative to the cap base in a plane that is parallel to the cap base, and in that the mouthpiece opening is formed such that the at least one mouthpiece opening is raised up with respect to a disk-like vessel cover of the discharge head of the receiving vessel and in that a rotary-alignment part consisting of at least one segment wall member, which interacts with the discharge head, is provided on the inner side of the cap base such that the rotary-alignment part rotates with the closure stopper and remains outside the at least one mouthpiece opening.

20. A combination according to claim 19, characterized in that the closure cap is held on the discharge head by means of a screw closure, and in that the screw closure is not yet active when the rotary-alignment part collides with the at least one mouthpiece opening.

21. A combination according to claim 20, characterized in that when the closure cap has been screwed on, the rotary-alignment part is disposed above the disk-like vessel cover and laterally with respect to the at least one mouthpiece opening.

22. A combination according to claim 19, characterized in that the rotary-alignment part interacts with the discharge head, and the closure stopper, despite the closure cap rotating, moves into a closure position without rotation, and purely by means of a lowering motion.

23. A combination according to claim 8, characterized in that the rotary-alignment part is formed on an arc of a circle which intersects the closure stopper or the mouthpiece opening.

24. A combination according to claim 19, characterized in that the rotary-alignment part is formed on an arc of a circle which intersects the closure stopper or the mouthpiece opening.

* * * * *